US005865949A

United States Patent [19]

Pere et al.

[11] Patent Number: 5,865,949

[45] **Date of Patent: *Feb. 2, 1999**

[54] PROCESS FOR PREPARING AND TREATING MECHANICAL PULP WITH AN ENZYME PREPARATION HAVING CELLOBIOHYDRALASE AND ENDO-β-GLUCANASE ACTIVITY

[75] Inventors: Jaakko Pere, Vantaa; Matti Siika-aho; Liisa Viikari, both of Helsinki, all of Finland

[73] Assignee: Valtion Teknillinen Tutkimuskeskus, Espoo, Finland

[ * ] Notice: This patent issued on a continued prosecution application filed under 37 CFR 1.53(d), and is subject to the twenty year patent term provisions of 35 U.S.C. 154(a)(2).

[21] Appl. No.: 513,856

[22] PCT Filed: Mar. 3, 1994

[86] PCT No.: PCT/FI94/00079

§ 371 Date: Oct. 27, 1995

§ 102(e) Date: Oct. 27, 1995

[87] PCT Pub. No.: WO94/20667

PCT Pub. Date: Sep. 15, 1994

[30] Foreign Application Priority Data

Mar. 3, 1993 [FI] Finland ..... 930953

[51] Int. Cl.[6] ..... D21H 11/20; D21H 25/02

[52] U.S. Cl. ..... 162/24; 162/72; 435/278

[58] Field of Search ..... 162/72, 24, 25, 162/20; 455/277, 278

[56] References Cited

U.S. PATENT DOCUMENTS

| | | | |
|---|---|---|---|
| 4,923,565 | 5/1990 | Fuentes et al. | 162/72 |
| 5,116,474 | 5/1992 | Fuentes et al. | 162/72 |

FOREIGN PATENT DOCUMENTS

| | | | |
|---|---|---|---|
| 0 351 655 | 1/1990 | European Pat. Off. | 162/72 |
| 0 430 915 A1 | 6/1991 | European Pat. Off. . | |

OTHER PUBLICATIONS

Dialog Information Services, Paperchem, Dialog Accession No. 268138, Sinner et al. "Degradation of delignified sprucewood . . . ", Adv. in Chem. Ser. No. 181 May 1978 pp. 303/329.

Myers et al, Fungal Pretreatment of Aspen chips Improves Strength of Refiner Mechanical Pulp, Tappi J., pp. 105–108, May 1988.

*Primary Examiner*—Steven Alvo

*Attorney, Agent, or Firm*—Kubovcik & Kubovcik

[57] ABSTRACT

A process for treating mechanical pulp having a cellobiohydrolase activity effective for modifying crystalline parts of the cellulose, an endo-β-glucanase less than that which will significantly hydrolyze the cellulose, and a mannanase activity; and wherein the endo-β-glucanase activity is low compared to the cellobiohydrolase activity.

11 Claims, No Drawings

PROCESS FOR PREPARING AND TREATING MECHANICAL PULP WITH AN ENZYME PREPARATION HAVING CELLOBIOHYDRALASE AND ENDO-β-GLUCANASE ACTIVITY

The present invention relates to a process in accordance with the preamble of claim 1 for preparing mechanical pulp.

According to a process of this kind, the wood raw material is disintegrated into chips, which then are defibered to the desired freeness value. During the production process, the raw material is subjected to an enzymatic treatment.

The invention also relates to an enzyme preparation according to the preamble of claim 16, suitable for the treatment of mechanical pulp.

The chemical and mechanical pulps possess different chemical and fibre technical properties and thus their use in different paper grades can be chosen according to these properties. Many paper grades contain both types of pulps in different proportions according to the desired properties of the final paper products. Mechanical pulp is often used to improve or to increase the stiffness, bulkyness or optical properties of the product.

In paper manufacture the raw material have first to be defibered. Mechanical pulp is mainly manufactured by the grinding and refining methods, in which the raw material is subjected to periodical pressure impulses. Due to the friction heat, the structure of the wood is softened and its structure loosened, leading finally to separation of the fibres (1).

However, only a small part of the energy spent in the process is used to separate the fibres: the major part being transformed to heat. Therefore, the total energy economy of these processes is very poor.

Several methods for improving the energy economy of mechanical pulping are suggested in the prior art. Some of these are based on pretreatment of chips by, e.g., water or acid (FI Patent Specifications Nos. 74493 and 87371). Also known are methods which comprise treating the raw material with enzymes to reduce the consumption of the refining energy. Thus. Finnish Patent Application No. 895676 describes an experiment in which once-refined pulp was treated with a xylanase enzyme preparation. It is stated in the application that this enzyme treatment would, to some extent, decrease the energy consumption. In said prior art publication the possibility of using cellulases is also mentioned, but no examples of these are given nor are their effects shown. As far as isolated, specified enzymes are concerned, in addition to hemicellulases, the interest has been focused on lignin modifying enzymes, such as laccase (5). A treatment using the laccase enzyme did not, however, lead to decreased energy consumption (5).

In addition to the afore-mentioned isolated enzymes, the application of growing white rot fungi in the manufacture of mechanical pulps has also been studied. Carried our before defiberization, such a treatment with a white rot fungus has been found to decrease the energy consumption and to improve the strength properties of these pulps (6,7,8). The drawbacks of these treatments are, however, the long treatment time needed (mostly weeks), the decreased yield (85 to 95%), the difficulty to control the process and the impaired optical properties.

The aim of this method of invention is to remove the drawbacks of the known techniques and to provide a completely new method for the production of mechanical pulp.

It is known that the amount and temperature of water bound to wood are of great importance for the energy consumption and quality of the pulp (1). The water bound to wood is known to decrease the softening temperature of hemicelluloses and lignin between the fibres and simultaneously to weaken the interfibre bonding, which improves the separation of fibres from each others (2). During refining the energy is absorbed (bound) mainly by the amorphous parts of the fibre material, i.e. the hemicellulose and lignin. Therefore, an increase of the portion of amorphous material in the raw material improves the energy economy of the refining processes.

The invention is based on the concept of increasing the amorphousness of the raw material during mechanical pulping by treating the raw material with a suitable enzyme preparation, which reacts with the crystalline, insoluble cellulose. By treating the raw material also with another enzyme, which improves the action of that enzyme active on crystalline cellulose, the efficiency of the treatment can further be enhanced.

The enzymes responsible for the modification and degradation of cellulose are generally called "cellulases". These enzymes are comprised of endo-β-glucanases, cellobiohydrolases and β-glucosidase. In simple terms, even mixtures of these enzymes are often referred to as "cellulase", using the singular form. Very many organisms, such as wood rotting fungi, mold and bacteria are able to produce some or all of these enzymes. Depending on the type of organism and cultivation conditions, these enzymes are produced usually extracellularly in different ratios and amounts.

It is generally well known that cellulases, especially cellobiohydrolases and endoglucanases act strongly synergistically, i.e. the concerted, simultaneous effect of these enzymes is more efficient than the sum of the effects of the individual enzymes used alone. Such concerted action of enzymes, the synergism, is however, usually not desirable in the industrial applications of cellulases on cellulosic fibres. Therefore, it is often desired to exclude the cellulase enzymes totally or at least to decrease their amount. In some applications very low amounts of cellulases are used for e.g. the removal of the fines, but in these applications the most soluble compounds are hydrolyzed to sugars in a limited hydrolysis as a result of the combined action of the enzymes (3,4).

In our experiments we have been able to show that a synergistically acting cellulase enzyme product, i.e. the "cellulase" cannot be used to improve the manufacture of mechanical pulps because the application of this kind of enzyme product leads to the hydrolysis of insoluble cellulose and thus impairs the strength properties of the fibres. In connection with the present invention, however, it has surprisingly been found that by using a cellulase enzyme preparation, which does not posses a synergistic mode of action, cellulose can be modified in an advantageous way and desired modifications can be achieved without remarkable hydrolysis or yield losses. According to the method of invention a cellulase preparation, having an essential cellobiohydrolase activity and—as compared with the cellobiohydrolase activity—a low endo-β-glucanase activity, if any, is used.

Suprisingly we have found out that the action of the cellobiohydrolase can specifically be improved by the addition of a mannanase.

The cellulase enzymes are composed of functionally two different domains: the core and the cellulose binding domain (CBD), in addition to the linker region combining these two domains. The active site of the enzyme is situated in the core. The function of the CBD is thought to be mainly responsible for the binding of the enzyme to the insoluble substrate. If the tail is removed, the affinity and the activity of the enzyme towards high molecular weight and crystalline substrates is essentially decreased.

According to the process of the invention, the raw material to be refined is treated with an enzyme, able specifically to decrease the crystallinity of cellulose. This enzyme can be e.g. cellobiohydrolase or a functional part of this enzyme and, as a cellulase enzyme preparation, it acts non-synergistically, as described above. In this context, "functional parts" designate primarily the core or the tail of the enzyme. Also mixtures of the above mentioned enzymes, obtainable by e.g. digestion (i.e. hydrolysis) of the native enzymes can be used.

Within the scope of the present application, the term "enzyme preparation" is used for designating any product containing at least one cellobiohydrolase enzyme and at least one mannanase enzyme or structural parts of these. Thus, an enzyme preparation can, for instance, comprise a growth medium containing said enzymes or a mixture of two or several separately produced enzymes.

For the purpose of the present application, the term "cellobiohydrolase activity" denotes an enzyme preparation, which is capable of modifying the crystalline parts of cellulose.

Thus, the term "cellobiohydrolase activity" includes particularly those enzymes, which produce cellobiose from insoluble cellulose substrates. This term covers, however, also all enzymes, which do not have a clearly hydrolyzing effect or which only partially have this effect but which, in spite of this, modify the crystalline structure of cellulose in such a way that the ratio of the crystalline and amorphous parts of the lignocellulosic material is diminished, i.e. the part of amorphous cellulose is increased. These last-mentioned enzymes are exemplified by the functional parts of e.g. cellobiohydrolase together or alone.

"Mannanase" or "mannanase-activity", respectively, refers to an enzyme, which is capable of cleaving polyose chains containing mannose units (mannopolymers), such as glucomannan, galactoglucomannan and galactomannan. Endo-1,4-β-mannanase can be mentioned as an example of mannanases.

According to the invention the treatments with a cellobiohydrolase and a mannanase are performed simultanously or sequentially. In the latter case it is preferred to perform the mannanase treatment or the treatment with a cellobiohydrolase immediately one after the other without any washing step between in order to utilize the synergistic effect of the combined use. According to a particularly preferred embodiment of the invention, the enzymatic treatments are performed by mixing the pulp with an enzymatic preparation, which contains both cellobiohydrolase activity and mannanase activity. This type of enzyme preparation can be obtained by mixing two enzyme preparations: one containing cellobiohydrolase activity and the other one containing mannanase activity. According to the invention the enzyme preparation can also be a growth filtrate, where a strain of a microorganism producing cellobiohydrolase and mannanase has been grown. This type of a strain is exemplified by genetically modified microorganisms, to which the genes coding for cellobiohydrolase and mannanase have been transferred and which does not produce unwanted or detrimental enzymes.

According to the process of the present invention, the enzyme treatment is preferably carried out on the "coarse pulp" of a mechanical refining process. This term refers in this application to a lignocellulosic material, used as raw material of the mechanical pulp and which already has been subjected to some kind of fiberizing operation during mechanical pulping e.g. by refining or grinding. Typically, the drainability of the material to be enzymatically treated, is about 30 to 1,000 ml. preferably about 300 to 700 ml. When applied directly to the chips, the enzyme treatment is usually not as efficient, because it is difficult to achieve an efficient diffusion (adsorption) of the enzyme preparation into the fibres of the raw material, if still in the form of chips. In contrast, e.g. a pulp, once refined, is well suited for use in the method of invention. The term coarse pulp thus encompasses, e.g., once refined or ground pulp, the rejects and long fibre fractions, and combinations of these, which have been produced by thermomechanical pulping (e.g. TMP) or by grinding (e.g. GW and PGW). It is essential for the invention that the enzyme treatment be carried out at least before the final refining stage.

The process is not limited to a certain wood raw material, but it can be applied generally to both soft and hard wood species, such as species of the order of Pinacae (e.g. the families of Picea and Pinus), Salicaceae (e.g. the family of Populus) and the species in the family of Betula.

According to a preferred embodiment of the invention refined (e.g. once-refined) mechanical pulps, having drainabilities in the range of 50 to 1,000 ml, are treated with an enzyme preparation which contains cellobiohydrolase and mannanase enzymes at 30° to 90° C., in particular at 40° to 60° C., at a consistency of 0.1 to 20%, preferably 1 to 10%. The treatment time is 1 min to 20 h, preferably about 10 min to 10 h. in particular about 30 min to 5 h. The pH of the treatment is held neutral or slightly acid or alkaline, a typical pH being 3 to 10, preferably about 4 to 8. The enzyme dosage varies according to the type of pulp and the cellobiohydrolase activity of the preparation, but is typically about 1 μg to 100 mg of protein per gram of od. pulp. Preferably, the enzyme dosage is about 10 μg to 10 mg, in particular 50 μg–10 mg of protein per gram of pulp.

The process according to the present invention can be combined with treatments carried out with other enzymes, such as hemicellulases (e.g. xylanases, glucuronidases and mannanases) or esterases. In addition to these enzymes, additional enzyme preparations containing β-glucosidase activity can be used in the present process, because this kind of β-glucosidase activity prevents the end product inhibition and increases the efficiency of the method.

Cellobiohydrolase enzyme preparations are produced by growing suitable micro-organism strains, known to produce cellulase. The production strains can be bacteria, fungi or mold. As examples, the micro-organisms belonging to the following species can be mentioned:

Trichoderma (e.g. *T. reesei*), Aspergillus (e.g. *A. niger*), Fusarium, Phanerochaete (e.g. *P. chrysosporium;* [12]), Penicillium (e.g. *P. janthinellum, P. digitatum*), Streptomyces (e.g. *S. olivochromogenes, S. flavogriseus*), Humicola (e.g. *H. insolens*), Cellulomonas (e.g. *C. fimi*) and Bacillus (e.g. *B. subtilis, B. circulans,* [13]). Also other fungi can be used, strains belonging to species, such as Phlebia, Ceriporiopsis and Trametes.

It is also possible to produce cellobiohydrolases or their functional parts with strains, which have been genetically improved to produce specifically these proteins or by other genetically modified production strains, to which genes, coding these proteins, have been transferred. When the genes coding the desired protein(s) (14) have been cloned it is possible to produce the protein or its part in the desired host organism. The desired host may be the fungus *T. reesei* (16), a yeast (15) or some other fungus or mold, from species such as Aspergillus (18), a bacterium or any other micro-organism, whose genetic is sufficiently known.

According to a preferred embodiment the desired cellobiohydrolase is produced by the fungus *Trichoderma reesei.* This strain is a generally used production organism and its cellulases are fairly well known. *T. reesei* synthesizes two cellobiohydrolases, which are later referred to as CBH I and CBH II, several endoglucanases and at least two β-glucosidases (17). The biochemical properties of these enzymes have been extensively described on pure cellulosic substrates. Endoglucanases are typically active on soluble and amorphous substrates (CMC, HEC, β-glucan). whereas the cellobiohydrolases are able to hydrolyze only crystalline cellulose. The cellobiohydrolases act clearly synergistically on crystalline substrates, but their hydrolysis mechanisms are supposed to be different from each other. The present knowledge on the hydrolysis mechanism of cellulases is based on results obtained on pure cellulose substrates, and may not be valid in cases, where the substrate contains also other components, such as lignin or hemicellulose.

The cellulases of *T. reesei* (cellobiohydrolases and endoglucanases) do not essentially differ from each other with respect to their optimal external conditions, such as pH or temperature. Instead they differ from each other with respect to their ability to hydrolyze and modify cellulose in the wood raw material.

As far as their enzymatic activities are concerned, the cellobiohydrolases I and II differ also to some extent from each other. These properties can be exploited in the present invention. Therefore, it is particularly preferable to use cellobiohydrolase I (CBH I) produced by *T. reesei* according to the present invention for reducing the specific energy consumption of mechanical pulps. The pI value of this enzyme is, according to data presented in the literature, 3.2 to 4.2 depending on the form of the isoenzyme (19) or 4.0 to 4.4, when determined according to the method presented in Example 2. The molecular weight is about 64,000 when determined by SDS-PAGE. It must be observed, however, that there is always an inaccuracy of about 10% in the SDS-PAGE method. Cellobiohydrolases alone or combined to e.g. hemicellulases can be particularly preferably used for the modification of the properties of mechanical pulps, e.g. for improving the technical properties of the paper (i.e. the handsheet properties) prepared from these pulps. Naturally, also mixtures of cellobiohydrolases can be used for the treatment of pulps.

The mannanase used in the present process can be produced by fungi or bacteria, such as microorganisms belonging to the following genera: Trichoderma (e.g. *T. reesei*), Aspergillus (e.g. *A. niger*), Phanerochaete (e.g. *P. chrysosporium*), Penicillium (e.g. *P. janthinelium, P. digitatum*) and Bacillus. As a host organism for mannanase production a white-rot fungi belonging to the following genera such as Phlebia, Ceriporiopsis and Trametes can be used.

The two main *Trichoderma reesei* mannanases, which have pI-values of 4.6 and 5.4 and molecular weights of 51 kDa and 53 kDa, respectively, can be mentioned as examples of suitable mannanases.

It is also possible to produce mannanases by strains, which have been improved to produce the proteins in question, or by other genetically improved host organisms, where the genes coding for these proteins have been transferred. When the genes coding for the desired protein(s) have been cloned [15], it is possible to produce the protein in a desired host organism. The desired host may be the fungus *T. reesei,* a yeast, an other fungus or mold from genera such as Aspergillus, a bacterium or any other microorganism, whose genetic is suffiently known.

Even the production of mannanase by the original host organism (e.g. Trichoderma) can be improved or modified after gene isolation by known gene means, by, for instance, transferring several copies of the chromosomal mannanase gene into the fungus under the (e.g. stronger) promoter of another gene and thus to provide mannanase expression under desired growth conditions, such as on the culture media which natively do not produce mannanase.

According to one preferred embodiment the desired mannanases can be produced by *Trichoderma reesei.* This strain is a generally used production organism and its hemicellulases are fairly well known. *T. reesei* synthetizes at least five mannanases.

According to the present invention cellobiohydrolases and mannanases are isolated from the rest of proteins in the culture filtrate by a fast separation method based on an anionic ion exchanger. The method is described in detail in Examples 1 and 3. The invention is not, however, restricted to this enzyme isolation method, but it is possible to isolate or enrich the enzyme with other known methods. If the production strain does not produce harmful enzymes, the culture filtrate can be separated and enriched using well known methods.

Significant advantages can be obtained with this invention. Thus, with this method the specific energy consumption can be remarkably decreased; as the examples described below show in addition to a lower energy consumption also better optical properties of the pulp can be achieved using the method of invention, as compared with untreated raw materials. According to the method of invention, in which the synergistic action of cellulases is absent or only insignificant, also the problems involved in the above mentioned fungal treatments can be avoided. Thus, the treatment time lasts only for few hours, the yield is extremely high, the quality of the pulp is good and the connection of the method to the present processes is simple.

The method can be applied in all mechanical or semi-mechanical pulping methods, such as in the manufacture of ground wood (GW, PGW), thermomechanical pulps (TMP) and chemimechanical pulps (CTMP).

In the following, the invention is described in more detail with the help of the following non-limiting examples.

EXAMPLE 1

Purification of cellobiohydrolase I

The fungus *Trichoderma reesei* (strain VTT-D-86271, RUT C-30) was grown in a 2 $m^3$ fermenter on a media containing 3% (w/w) Solka floc cellulose, 3% corn steep liquor. 1.5% KH2PO4 and 0.5% $(NH_4)_2SO_4$. The temperature was 29° C. and the pH was controlled between 3.3 and 5.3. The culture time was 5 d. whereafter the fungal mycelium was separated by a drum filter and the culture filtrate was treated with bentonite, as described by Zurbriggen et al. (10). After this the liquor was concentrated by ultrafiltration.

The isolation of the enzyme was started by buffering the concentrate by gel filtration to pH 7.2 (Sephadex G-25 coarse). The enzyme solution was applied at this pH (7.2) to an anion exchange chromatography column (DEAE-Sepharose FF), to which most of the proteins in the sample, including CBH I, were bound. Most of the proteins bound to the column including also other cellulases than CBH I were eluted with a buffer (pH 7.2) to which sodium chloride was added to form a gradient in the eluent buffer from 0 to 0.12M. The column was washed with a buffer at pH 7.2, containing 0.12M NaCl, until no significant amount of protein was eluted. CBH I was eluted by increasing the concentration of NaCl to 0.15M. The purified CBH I was collected from fractions eluted by this buffer.

EXAMPLE 2

Characterization of CBH I

The protein properties of the enzyme preparation purified according to example 1 were determined according to usual methods of protein chemistry. The isoelectric focusing was run using a Pharmacia Multiphor II System apparatus according to the manufacturer's instructions using a 5% polyacrylamide gel. The pH gradient was achieved by using a carrier ampholyte Ampholine, pH 3.5–10 (Pharmacia), where a pH gradient between 3.5 and 10 in the isoelectric focusing was formed. A conventional gel electrophoresis under denaturating conditions (SDS-PAGE) was carried out according to Laemmli (11), using a 10% polyacrylamide gel. In both gels the proteins were stained with silver staining (Bio Rad. Silver Stain Kit).

For CBH I the molecular weight obtained was 64 000 and the isoelectric point 4.0–4.4. As judged from the gels, over 90% of the proteins consisted of CBH I.

EXAMPLE 3

Isolation of mannanase

In order to isolate the enzyme, the culture medium of *Trichoderma reesei* (Rut C-30. VTT D-86271) was first treated with bentonite, as described by Zurbriggen et al. (1990). Then the solution was concentrated by ultrafiltration and the concentrate was dried by spray drying.

The isolation of the enzyme was started by dissolving the spray dried culture medium in a phosphate buffer. The insoluble material was separated by centrifugation and the enzyme solution was buffered by gel filtration to pH 7.2 (Sephadex G-25). The enzyme solution was pumped at this pH through a cation exchange chromatography column (CM-Sepharose FF), to which a part of the proteins of the sample were bound. The desired enzyme was collected in the fractions eluted through the column.

At said pH (pH 7.2) the enzyme solution was pumped to an anion exchange chromatography column (DEAE-Sepharose FF), to which most of the proteins of the sample were bound. The desired enzyme was collected in the fraction eluted through the column.

The enzyme-containing fractions were further purified by using hydrophobic interaction chromatography (Phenyl Sepharose FF). The enzyme was bound to said material at a salt concentration of 0.3M $(NH_4)_2SO_4$. The bound enzyme was eluted with a buffer at pH 6.5, so as to form a decreasing linear concentration gradient of $(NH_4)_2SO_4$ from 0.3 to 0M. After this, elution was continued with the buffer of pH 6.5. The mannanase enzyme was collected at the end of the gradient and in the fractions collected after that.

The enzyme solution was buffered by gel filtration to pH 4.3 (Sephadex G-25). The enzyme was bound at this pH to a cation exchange chromatography column (CM-Sepharose FF), and a part of the proteins bound to the column (i.a. most of the remaining cellulases) were eluted with a buffer, pH 4.4. The mannanase enzyme was eluted with a buffer, pH 4.3, to which sodium chloride was added in order to form a linear cocentration gradient of sodium chloride from 0 to 0.05M. The purified enzyme was collected in the fractions eluted by the gradient.

EXAMPLE 4

Characterization of mannanase

The protein properties of the enzyme preparation purified according to Example 3 were determined by methods known per se in the protein chemistry. The molecular weights were determined by the SDS-PAGE -method.

The preparation contains two mannanase isoenzymes (20), which biochemically and functionally proved to be almost identical. The pIs of the enzymes are 4.6 and 5.4, respectively. The molecular weights are 51 kDa and 53 kDa, respectively. The optimum pH of both isoenzymes is 3–3.5 and optimum temperature for activity testing is 70° C.

EXAMPLE 5

Hydrolytic action of cellobiohydrolase and mannanase

Middle coarse fibers (mesh+100) fractioned from spruce TMP pulp were treated with CBH I and mannanase enzymes at 48° C. for 48 hours. The fractioned pulp was mixed in distilled water to obtain a consistency of 2% and the pH was set to 4.5 with sulphuric acid. In the experiment the enzyme dosages were as folllows: CBH I 2 mg/g and mannanase 0.1 mg/g. In the experiments above mentioned enzyme dosages were added to pulp samples separately or simultaneously. Amounts of reducing sugars, cellobiose (main hydrolytic product of CBH I) and mannose solubilized by the enzymes were analyzed and are shown in Table 1.

TABLE 1

Carbohydrates released by CBH I and mannanase from spruce TMP pulp (treatment time 48 hours, enzyme dosages: CBH I 2 mg/g and mannanase 0.1 mg/g)

| | Reducing sugars, | Conc. of cellobiose and mannose, g/l | |
|---|---|---|---|
| Treatment | % d.w. | Cellobiose | Mannose |
| CBH I | 0.61 | 0.12 | <0.01 |
| Mannanase | 0.50 | <0.01 | 0.01 |
| CBH I + mannanase | 1.68 | 0.21 | 0.03 |

A clear synergistic effect of the enzymes in the partial hydrolysis of spruce TMP pulp can clearly be recognized, when acting simultanously both enzymes solubilized more reducing sugars as well as cellobiose and mannose as compared to a situation where both enzymes acted alone.

EXAMPLE 6

The effects of the enzymatic treatment (CBH I+mannanase) on the specific energy consumption of mechanical pulping and on the optical properties of the pulps Spruce TMP pulp samples (CSF 640 ml) were treated with enzyme preparations, which contained CBH I alone and a mixture of CBH I and mannanase. The consistency of the pulp was 5% in tap water, treatment time 2 hours and temperature 45°–50° C. pH of the pulp was adjusted to 4.5 with sulphuric acid. In each experiment 1 kg (o.d.) of pulp was treated using enzyme dosages shown below:

1) CBH I 0.2 mg/g

2) CBH I 0.1 mg/g+mannanase 0.1 mg/g

After the treatments the pulps were dewatered and homogenized. The procedure for a control sample was otherwise the same but without an addition of an enzyme.

The pulps were refined with a Sprout-Waldron single rotating disk refiner using decreasing plate settings. The pulps were refined three times to obtain CSF values about 150–160 ml. Energy consumption of refining was measured in each case. From the refined pulps handsheets were also made and tested according to the SCAN-methods. Results are shown in Table 2.

TABLE 2

Specific energy consumption (at CSF level of 120 ml) and optical properties of the handsheets.

| Treatment | Spec. energy consumption, kWH/kg | ISO-brightness, % | Light scattering coeff. $m^2/kg$ | Light absorption coeff. $m^2/kg$ | Opacity % |
|---|---|---|---|---|---|
| Control | 2.25 | 58.0 | 50.1 | 2.87 | 92.3 |
| CBH I | 2.15 | 58.2 | 50.2 | 2.73 | 91.0 |
| CBH I + man | 2.0 | 59.8 | 52.5 | 2.46 | 91.0 |

According to the results it can be concluded that the treatment with CBH I+mannanase gives a lower energy consumption and improves ISO-brightness and light scattering as compared to the untreated control or to the CBH I treated sample.

References

1. Puumassan valmistus. Toim. Nils-Erik Virkola. Suomen Paperi-insinoorien yhdistys. Turku 1983.
2. D. A. Goring. Thermal Softening of Lignin. Hemicellulose and Cellulose. Pulp And Ppaer Magazine of Canada 64 (1963) 12, T517–27.
3. J-C Pommier. J-L Fuentes & G. Goma. Using enzymes to improve the process and the product quality in the recycled paper industry. Part 1: the basic laboratory work. TAPPI J. 72 (1989) 6, 187–191.
4. J-C Pommier, G. Goma, J-L Fuentes, C. Rousser, O. Jokinen. Using enzymes to improve the process and the product quality in the recycled paper industry. Part 2: Industrial applications. TAPPI J. 73 (1990) 12, 197–202.
5. K. Jokinen & M. Savolainen. Puun mekaanisen massan kasittely lakkaasilla. PSC Communications 18. Espoo 1991.
6. E. Setliff, R. Marton, G. Granzow & K. Eriksson. Biochemical pulping with white-rot fungi. TAPPI J. 73 (1990), 141–147.
7. G. Leatham, G. Myers & T. Wegner. Biomechanical pulping of aspen chips: energy savings resulting from different fungal treatments. TAPPI J. 73 (1990), 197–200.
8. M. Akhtar, M. Attridge, G. Myers, T. K. Kirk & R. Blanchette. Biomechanical pulping of lobiolly pine with different strains of the white-rot fungus *Ceriporiopsis subvermispora*. TAPPI J. 75 (1992), 105–109.
9. van Tilbeurgh, H. Bhikhabhai, R. Pettersson, L. and Claeyessens M. (1984) Separation of endo- and exo-type cellulases using a new affinity method. FEBS Lett. 169, 215–218.
10. Zurbriggen, B. Z., Bailey, M. J., Penttilä. M. E., Poutanen. K. and Linko M. (1990) Pilot scale production of a heterologous *Trichoderma reesei* cellulase in *Saccharomyces cerevisiae*. J. Biotechnol. 13, 267–278.
11. Laemmli, U. K. Cleavage of structural proteins during the assembly of the head of bacteriophage T4. Nature 227 (1970), 680–685.
Chen H., Hayn M. & Esterbauer H. Purificatio and characterization of two extracellular β-glucosidases from *Trichoderma reesei*. Biochim.Biophys.Acta 1121 (1992), 54–60.
12. Chen H., Hayn M. & Esterbauer H. Purification and characterization of two extracellular β-glucosidases from *Trichoderma reesei*. Biochim.Biophys.Acta 1121 (1992), 54–60.
13. Covert, S., Vanden Wymelenberg, A. & Cullen, D., Structure, organisation and transcription of a cellobiohydrolase gene cluster from *Phanerochaete chrysosporium*, Appl. Environ. Microbiol. 58 (1992), 2168–2175.
14. Ito, S., Shikata, S., Ozaki, K., Kawai, S., Okamoto, K., Inoue, S., Takei, A., Ohta, Y. & Satoh, T., Alkaline cellulase for laudry detergents: production by Bacillus sp. KSM-635 and enzymatic properties, Agril. Biol. Chem. 53 (1989), 1275–1281
15. Teeri. T., Salovuori. I. & Knowles. J., The molecular cloning of the major cellobiohydrolase gene from *Trichoderma reesei* Bio/Technolgy 1 (1983), 696–699
16. Penttilä. M., Antre. L., Lehtovaara. P., Bailey, M., Teeri, T. & Knowles, J. Effecient secretion of two fungal cellobiohydrolases by *Saccharomyces cerevisiae*. Gene 63 (1988) 103–112.
17. Mitsuishi. Y., Nitisinprasert, S., Saloheimo. M., Biese, I., Reinikainen, T., Clayssens. M., Keränen, S., Knowles. J. & Teeri, T. Site-directed mutagenesis of the putative catalysic residues of *Trichoderma reesei* cellobiohydrolase I and endoglucanase I. FEBS Lett. 275 (1990). 135–138
18. Mandels, M. & Weber, J. The production of cellulases. Advances in Chemistry Series, No. 95, 1969, 391–414
19. Stàbrand H. Siika-aho M., Tenkanen M. and Viikari L. (1993) Purification and characterization of two β-mannanases from *Trichoderma reesei*. Journal of Biotechnology, pp. 229–242.
20. van den Hondel, C., Punt, P. & van Gorcom, R. Production of extracellular proteins by the filamentous fungus Aspergillus. Antonio van Leeuwenhoek 61 (1992), 153–160
21. Tomme, P., McCrae, S., Wood, T. & Claeyssens, M. Chromatographic separation of cellulolytic enzymes. Methods Enzymol. 160 (1988), 187–193.

We claim:

1. A process for preparing mechanical pulp from a wood raw material, comprising:

(i) disintegrating the wood raw material into chips;

(ii) refining or grinding the chips to obtain a coarse pulp having a drainability of from about 30 to 1,000 CSF;

(iii) treating the coarse pulp with an enzyme having a cellobiohydrolase activity effective for modifying crystalline parts of the cellulose and as compared with the cellobiohydrolase activity, a low endo-β-glucanase activity, wherein the endo-β-glucanase activity is less than that which will significantly hydrolyze the cellulose, and an enzyme exhibiting mannanase activity; and (iv) mechanically defibering the enzyme treated coarse pulp to lower the freeness to a desired freeness value.

2. A process according to claim 1, wherein the coarse pulp is treated simultaneously with said enzymes.

3. A process according to claim 1, wherein an enzyme preparation is used whose cellobiohydrolase activity has been produced by cultivating on a suitable growth medium a microorganism strain belonging to the species Trichoderma, Aspergillus, Phanerochaete, Penicillium, Streptomyces, Humicola or Bacillus.

4. A process according to claim 3, wherein the enzyme preparation used contains the cellobiohydrolase I produced by the fungus strain *Trichoderma reesei* having a molecular weight, determined by SDS-PAGE, of about 64,000 and an isoelectric point of about 3.2 to 4.4.

5. A process according to claim 1, wherein an enzyme preparation is used, whose mannanase activity has been produced by cultivating on a suitable growth medium a microorganism strain belonging to the species Trichoderma, Aspergillus, Phanerochaete, Penicillium, Streptomyces, Humicola or Bacillus.

6. A process according to claim 5, wherein the enzyme preparation used contains a mannanase produced by the fungus *Trichoderma reesei* having a molecular weight, determined by SDS-PAGE, of about 51 kDa and an isoelectric point of about 4.6, or a mannanase produced by *T. reesei* having a molecular weight, determined by SDS-PAGE, of about 53 kDa and an isoelectric point of about 5.4, or a mixture thereof.

7. A process according to claim 1, wherein the enzyme preparation used has been produced by a strain genetically improved for producing an enzyme having cellobiohydrolase and/or mannanase activity, or by a strain to which the gene coding for said activity has been transferred.

8. A process according to claim 1, wherein the enzyme treatment is carried out at 30° to 90° C. at a consistency of about 0.1–20%, the duration of the treatment being about 1 min–20 h.

9. A process according to claim 8, wherein the coarse pulp enzymatically treated comprises once-refined or once-ground pulp, fibre rejects or long fibre fractions or combinations thereof.

10. A process according to claim 1, wherein the enzyme preparation is dosed in an amount of about 1 $\mu$g–100 mg protein per gram of dry pulp.

11. A process according to claim 1, wherein the mechanical pulp is prepared by the GW, PGW, TMP or CTMP process.

* * * * *